US008001891B2

(12) United States Patent
Eckert et al.

(10) Patent No.: US 8,001,891 B2
(45) Date of Patent: Aug. 23, 2011

(54) PRINTING MACHINE SYSTEM

(75) Inventors: Günther Oskar Eckert, Zellingen (DE); Burkard Otto Herbert, Würzburg (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 757 days.

(21) Appl. No.: 11/988,893

(22) PCT Filed: Aug. 17, 2006

(86) PCT No.: PCT/EP2006/065419

§ 371 (c)(1),
(2), (4) Date: Mar. 10, 2008

(87) PCT Pub. No.: WO2007/071459

PCT Pub. Date: Jun. 28, 2007

(65) Prior Publication Data

US 2009/0031908 A1 Feb. 5, 2009

Related U.S. Application Data

(60) Provisional application No. 60/750,357, filed on Dec. 15, 2005.

(30) Foreign Application Priority Data

Mar. 13, 2006 (DE) ..... 10 2006 011 478

(51) Int. Cl.
*B41F 7/00* (2006.01)
*B41F 13/54* (2006.01)

(52) U.S. Cl. ..... 101/221; 101/224; 101/180

(58) Field of Classification Search ..... 101/180, 101/181, 179, 178, 224, 225, 227, 226, 228, 101/221, 220, 219
See application file for complete search history.

(56) References Cited

U.S. PATENT DOCUMENTS 571,850 A * 11/1896 Wood ..... 270/14

(Continued)

FOREIGN PATENT DOCUMENTS

DE 40 12 396 A1 10/1991

(Continued)

OTHER PUBLICATIONS

Kipphan, Helmut, "Handbuch der Printmedien, Technologien und Produktionsverfahren," Springer.

(Continued)

*Primary Examiner* — Judy Nguyen
*Assistant Examiner* — Leo Hinze
(74) *Attorney, Agent, or Firm* — Jones, Tullar & Cooper, P.C.

(57) ABSTRACT

A printing machine system includes a first printing machine which is configured as a newspaper printing machine and which has at least two first printing units that are structured as printing towers, each with a plurality of superimposed printing groups that are usable for multicolor printing. The first printing machine also includes a first folder structure which is arranged in a machine alignment of the at least two first printing units. A second printing machine has at least one second printing unit and a second folder structure. The first printing units and the at least one second printing unit are arranged in one row. The first printing units, which are configured as printing towers, differ from the at least one second printing unit in at least one of their effective printing length and a circumference of imaging printing group cylinders.

41 Claims, 9 Drawing Sheets

U.S. PATENT DOCUMENTS

| | | | | |
|---|---|---|---|---|
| 1,972,506 | A | 9/1934 | Wood | |
| 1,973,034 | A * | 9/1934 | Ball | 270/5.01 |
| 5,117,753 | A | 6/1992 | Mamberer | |
| 5,775,222 | A | 7/1998 | Zweifel et al. | |
| 6,082,259 | A | 7/2000 | Siegenthaler et al. | |
| 6,374,731 | B1 | 4/2002 | Walczak et al. | |
| 6,832,549 | B2 * | 12/2004 | Satoh | 101/228 |
| 6,892,635 | B2 | 5/2005 | Herbert | |
| 6,899,026 | B2 | 5/2005 | Weis | |
| 7,159,514 | B2 | 1/2007 | Eckert et al. | |
| 7,845,274 | B2 * | 12/2010 | Elschner et al. | 101/181 |
| 2001/0029856 | A1 | 10/2001 | Pautrat | |
| 2002/0189470 | A1 * | 12/2002 | Holm | 101/375 |
| 2004/0250717 | A1 | 12/2004 | Masuch et al. | |
| 2006/0162595 | A1 | 7/2006 | Herbert | |
| 2006/0187472 | A1 | 8/2006 | Elschner et al. | |
| 2009/0031907 | A1 | 2/2009 | Eckert et al. | |

FOREIGN PATENT DOCUMENTS

| | | | |
|---|---|---|---|
| DE | 102 38 010 | A1 | 3/2004 |
| DE | 20 2005 010 058 | | 12/2005 |
| DE | 102005039073 | A1 | 3/2007 |
| EP | 0 741 019 | | 4/1996 |
| EP | 0 888 887 | A2 | 6/1998 |
| EP | 1391410 | A2 | 2/2004 |
| EP | 1 683 634 | A1 | 1/2006 |
| WO | WO 03/031182 | A1 | 4/2003 |
| WO | WO 2004/014770 | A1 | 2/2004 |
| WO | WO 2004/024448 | A1 | 3/2004 |
| WO | WO 2004/094145 | A1 | 11/2004 |

OTHER PUBLICATIONS

Braun, Alexander, "Atlas des Zeitungs- und Illustrationsdruckes," Polygraph Verlag GMBH.

Alexander Braun, Atlas des Zeitungs- und Jllustrationsdruckes, Technisches Kabinett; 1960, pp. 131, 152-167, Germany.

Wolfgang Walenski, Der Rollen Offset Druck, Geschichte Moderne Technik Materialien, 1995, pp. 80-82, 86, 188, 189-192, 205, Germany.

Helmut Teschner, Offset druck technik Technologien und Werkstoffe in der Druckindustrie, Fach Schriften Verlag, 1997, pp. 10/25-10/28, 10/32, 10/38, Germany.

Helmut Kipphan, Handbook of Print Media, Technologies and Production Methods, 2000, pp. 124-126, 166-184, 289-291, 345-348, 761-771, Germany.

Oscar Frei, Rollenoffset Techniken Systeme Maschinen, Polygraph Verlag, 1979, pp. 17, 51-54, Germany.

* cited by examiner a)

b)

c)

PRINTING MACHINE SYSTEM

CROSS-REFERENCE TO RELATED APPLICATIONS

This application is the U.S. national phase, under 35 USC 371, of PCT/EP2006/065419, filed Aug. 17, 2006; published as WO 2007/071459 A1 on Jun. 28, 2007 and claiming priority to U.S. 60/750,357, filed Dec. 15, 2005 and to DE 10 2006 011 478.7, filed Mar. 13, 2006, the disclosures of which are expressly incorporated herein by reference.

FIELD OF THE INVENTION

The present invention is directed to a printing press system, and in particular to such a system for use in newspaper printing and in semi-commercial printing. The printing press system has a first printing press and a second printing press. The printing units of the first printing press and of the second printing press are arranged in a line.

BACKGROUND OF THE INVENTION

A printing press having printing units for use in newspaper printing, as well as a printing unit for use in printing semi-commercial products, is known from DE 102 38 919 A1. Production of the printed products is performed on a common folding apparatus having a newspaper and an illustration folding apparatus.

WO 2004/024448 A1 discloses a printing press with several printing units, with at least one dryer and with a folding apparatus. The printing units are arranged next to each other in relation to the axial direction of their cylinders. Projected into a horizontal plane, a path from the printing units to a former structure, with three formers, has a 90° bend.

A printing press with several printing towers, for use in printing newspaper products, is disclosed in WO 03/031182 A1. The printing towers are arranged in an alignment extending perpendicularly in relation to the axial direction of their printing group cylinders, so that the printing press is embodied in a so-called in-line press arrangement. The direction of entry into formers of a former structure, which is arranged in a straight-line running direction, also extends along, or at least parallel, to the printing machinery alignment.

Two lines of printing presses, each having several printing groups arranged side-by-side, through which a web runs one after the other, is known from DE 40 12 396 A1. Added devices of the one printing press can be utilized for transferring the web into the other printing press.

A printing press with several side-by-side arranged printing groups and an aligned former structure is disclosed in U.S. Pat. No. 1,972,506 A. Partial webs, which have been imprinted in several colors can be conducted from printing groups, which are offset by 90° with respect to each other, onto the former structure of the first printing press.

DE 20 2005 010 058 U1, and EP 16 83 634 A1, both show a printing press with two partial printing press systems. The printing press systems are differently embodied in such a way that a web of material to be imprinted can be printed with different numbers of printed pages.

Examples of printing presses, or printing press systems having combined heatset/coldset lines of printing presses are provided in the publication "Handbuch der Printmedien" [Printing Media Handbook], Springer, 2000, pp. 357 and 358.

The publication of Alexander Braun "Atlas des Zeitungs— und Illustrationsdruckes" [Atlas of Newspaper and Illustration Printing], Polygraph, 1960, represents on page 152 a printing press with a printing group of a width of four plates and a double-width former structure with a downstream-located folding apparatus. Imprinted webs of one-page width from an envelope or insert printing press, with printing groups offset by 90° in relation to the first printing press, can be supplied to the first printing press in the folding apparatus.

SUMMARY OF THE INVENTION

The object of the present invention is directed to providing a printing press system, and in particular for providing such a system which is suited for variable printed production runs.

In accordance with the present invention, this object is attained by the provision of a printing press system having a first printing press, embodied as a newspaper printing press, and having at least two first printing towers and a first former structure. A second printing press includes at least one second printing unit. The first printing units, arranged as printing towers, and the at least one second printing unit are arranged in a line such that, in their projections of their widths onto a plane, they at least overlap each other. The first printing units, which are embodied as printing towers, differ in their maximum length effective for printing, and/or in the circumference of the image-conveying printing group cylinder, from the at least one second printing unit.

The advantages which can be obtained by the present invention consist, in particular, in that, in connection with the arrangement of two different printing presses and, for example also two kinds of different former structures in a printing press system, it is possible, in a simple and variable way, to form different, separate products, as well as to form the most diverse mixed products. By the combination of, for example, types of printing presses or printing units which are different from each other, it is possible to take the most diverse requirements regarding product variety and quality into consideration.

For example, a printing press system having, for example, a first newspaper printing press and a second printing press different from each other as to the number of pages, and/or the printing process, and/or the drying options, is laid out so that it is possible, in addition to a pure newspaper production, to also produce "improved" newspaper products or mixed products.

A production of two different printed products which, however, are independent of each other, such as, for example, a newspaper and possibly semi-commercial products, is possible independently of each other and without restrictions. The two printing presses, which may be, for example, heatset and coldset presses, can be selectively operated in one mode of operation, free of side effects, as completely independent presses.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
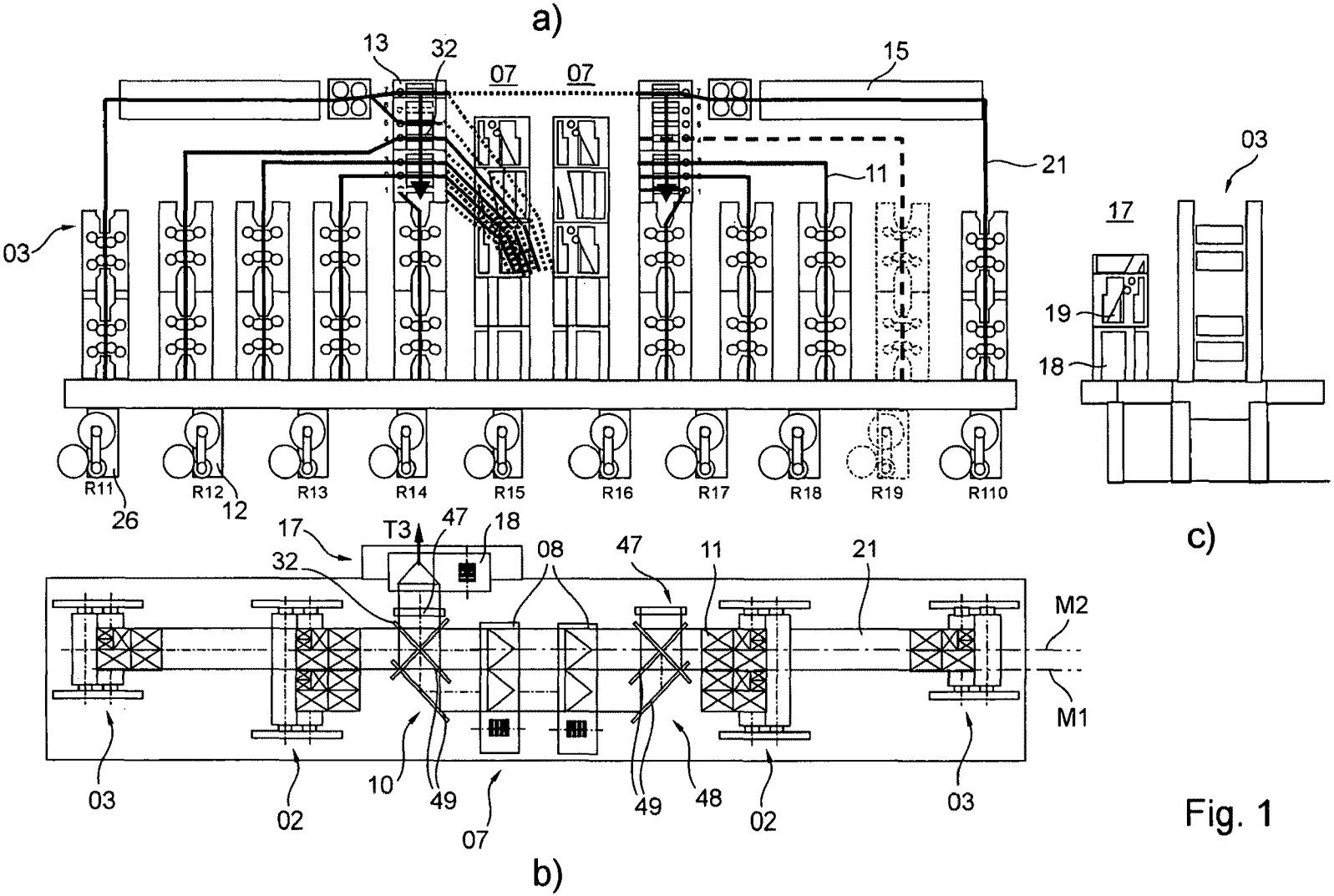
FIGS. 1*a*), 1*b*) and 1*c*) schematic representations of a first preferred embodiment of a printing press system, in FIGS. 2*a*) and 2*b*), schematic representations of a further preferred embodiment of a printing press system, in FIG. 3, a schematic front view of a further preferred embodiment of a printing press system, in FIG. 4, schematic front views of the former structures of the printing press system in accordance with FIG. 3, in FIG. 5, a schematic front views of a further preferred embodiment of a printing press system, in FIG. 6, a schematic representation for equipping a forme cylinder in the operating mode for newspaper printing in FIG. 6*a*) and for tabloid printing in FIG. 6*b*), in FIG. 7, schematic representations of former structures, in FIG. 8, further schematic representations of former structures, in FIGS. 9*a*), 9*b*) and 9*c*) schematic representations of the conduct of webs onto formers for forming a "pop-up product", and in FIGS. 10*a*) and 10*b*), schematic representations of the conduct of webs onto formers for forming a "pop-up product".

FIG. 1 shows a schematic top plan view of a printing press system in which, one or several printing units 02 of a first type, or first printing unit 02 of a first printing press 01, and in which one or several printing units 03 of a second type, for example, second printing unit 03 of a second printing press 31 are also provided. The first and second printing units 02, 03 are laterally offset, or are even possibly arranged at an angle, with respect to each other, in a manner to be described in greater detail below.

The two types of printing units 02, 03, or the two types of printing presses 01, 31, now differ in the width and/or in the circumference of their respective image-conveying printing group cylinder 04, 14, i.e. in the maximum cylinder length that is effective for printing and/or in the circumference of the image-conveying printing group cylinder 04, 14, such as, for example, the forme cylinder 04, 14, as discussed below. This means that they are embodied to have a length and/or a circumference corresponding to a differing number of printed pages of the same format, such as, for example, newspaper pages in broadsheet format, or supports the corresponding number of printed pages on the forme cylinder 04, 14. For example, the printing unit 02, 03 of the one type of printing group cylinders 04, 14, respectively, can be embodied with a width of four printed pages, and in particular four newspaper pages, and is thus referred to as having a "double-width" and, with at least the forme cylinder 04, being provided with a circumference corresponding to two printed pages or being "double-round", and in particular two newspaper pages, or "double-round", in a so-called "4/2 design". The printing unit 03, 02 of the other type can be configured in 4(length)/1 (circumference of at least the forme cylinder 14, 04) configuration, in a 2/2 design, "single-width" and "double-round", or in a 6/2 configuration, "triple-width" and "double round". With a single-round configuration, a printing group cylinder 06, 16, for example a transfer cylinders 06, 16, as discussed below, working together with the "single-round" forme cylinders 04, 14, can also be embodied to be double-round. In principle, the one printing press 01 or 31 can be embodied in one of the configurations 2/1, "single-width" and "single-round", 2/2, "single-width" and "double-round", 4/1, "double-width" and "single-round", 4/2, "double-width" and "double-round", 6/1, "triple-width" and "single-round", or 6/2, "triple-width" and "double-round". The other printing press 31, 01 can be embodied in a configuration which is different from the first of the mentioned configurations. It is also possible to embody a wider, such as, for example, a double-width printing unit 02, to be single-round, 4/1 configuration, and for the printing unit 03 of the second type to be of single-width and double-round, 2/2 configuration. Expressed in general terms, in an x/y configuration, the forme cylinder 04, 14 of the respective printing unit 02, 03 has a number of x print images on its circumference side-by-side in the longitudinal direction, and in the circumferential direction has a number y of print images, or the number of printing formes each with a print image, of the respective format, for example tabloid format or newspaper format, in the case of a newspaper format in particular in broadsheet format.

In the selection of the configuration of the printing press 01, 31, in regard to the differentiation in circumference between single circumference or double circumference configuration, a single circumference configuration for example 2/1, 4/1 or 6/1 can have advantages in regard to the printing formes to be exchanged in the course of a production change and/or in regard to the lateral skip in the product to be made, and/or a height of the press. A double circumference configuration, for example 2/2, 4/2, 6/2), however, can show advantages regarding a product amount which can be maximally produced in the course of a collection production. In regard to the differentiation in the printed pages arranged side-by-side in the longitudinal direction, the amount of production to be achieved, and/or the production efficiency are added decision criteria. If, for example in a mixed product, only a few special layers are needed, and in a single production run of this, for example wherein the second printing press 03, only produces in low numbers, a mere single-width configuration can, for example, be sufficient. Thus, it is possible, in the case of embodiments of different width and/or differing in circumference of the two types of printing units 02, 03, to provide a directed adaptation to the changes in a defined product spectrum.

In a triple-width, 6/1 or 6/2 embodiment of one of the printing units 02, 03, or of one of the printing presses 01, 31, it is possible to respectively arrange, on the transfer cylinder 06, 16 of a width of six printed pages, over its length, two continuous, three page-wide or three two page-wide printing blankets, which are not specifically represented, and in particular metal printing blankets with a dimensionally-stable support plate, for example metal plate, and a resilient and/or compressible coating. The embodiment with two three page-wide rubber blankets arranged side-by-side in the longitudinal direction is advantageous in connection with increased variability, such as with pop-up production, or with variable web width. The rubber blankets can each extend over the entire circumference and, in the case of several blankets arranged in the longitudinal direction, can be offset in respect to each other in the circumferential direction.

In addition to a differentiation with regard to their width and/or to their circumference, for example, the two types of printing units 02, 03, or the two types of printing presses 01, 31 can differ in regard to their printing process. Thus, it is possible, for example, for the printing units 02 of the one type to be configured as offset units, as direct print units, as flexographic printing units, or as a printing unit in accordance with a non-impact process, typically a printing process without printing formes, or having ink application without the mechanical action of printing cylinders on the material to be imprinted, such as, for example, for imprinting light-sensitive paper, inkjet printing or laser printing, and the printing press 01 can operate in accordance with the corresponding method. Then, the printing unit 03 of the other type can be configured in accordance with another one of the above-recited processes. For example, the one printing press 01 can be structured in particular as a newspaper printing press 01 with offset printing units, while the other one may have one, or several direct print or flexographic printing units or non-impact printing units. A printing press 01 can also be embodied as a newspaper printing press 01 with offset printing units, while the other printing press 31 may have offset printing units for job-lot printing, or in other words, may have printing groups with a substantially horizontal web run for high-quality commercial printing and a downstream arranged dryer, or may be structured as a job-lot printing press.

In addition to, or in place of a difference in the above mentioned printing process, the two types of printing units 02, 03, or the two types of printing presses 01, 31, can differ in that one of the printing presses 01, 31 is operated to include drying the freshly imprinted web, typically in accordance with the "heatset" method, see below regarding the use of the term "heatset", and the other without drying, such as in accordance with the "coldset" method. The printing press 01, 31, which is being operated in accordance with the heatset method, then has appropriate devices 15 for aiding drying, such as, for example, a dryer 15, and the associated printing units 03, 02 are embodied with appropriately modified units and/or additional devices, as will be discussed below. A printing press 01 can also advantageously be embodied as a newspaper printing press 01, in particular with preferably offset printing units which are equipped solely for newspaper and/or coldset printing, referred to as coldset printing units 02 for short, while the other printing press 31 has one or several offset printing units configured for semi-commercial and/or "heatset" printing and referred to as heatset printing unit 03 for short, as well as an assembly 15 for aiding drying. The prefix "heatset" is understood to not only mean the drying of the web by the use of a thermal method, but also, in contrast to "coldset", to drying by other mechanisms or devices for aiding drying, such as, for example, UV or IR dryers.

Several printing units 02 of the first type, such as "purely" cold-set printing units 02, and/or at least one printing unit 02 of the first type, such as, for example, a coldset printing unit 02 and a former structure 07, are arranged in the manner of a so-called in-line press arrangement 01, in a common machinery alignment M1 extending perpendicularly in respect to the axial direction of their printing group cylinders 04, 06. The machinery alignments M1, which are represented in the drawing figures, extend on the level of a plane of symmetry which halves the printing cylinders 04, 06 in respect to their axial length, and in this shape, they can also be called press center alignment M1. With several printing units 02 of the first type in a line arrangement, it is possible to additionally arrange the at least one former structure 07 assigned to the printing units 02 in this machinery alignment M1, i.e. in a "straight-line embodiment". In the case of offset printing, the printing group cylinders 04, 06 are, for example, embodied as forme cylinders 04, or as image-conveying printing group cylinders 04 and as a transfer cylinder 06. A folding group 08, for example in the case of a printing press 01 which is embodied as a newspaper printing press, a coldset folding group 08, is provided downstream of a former structure 07. The former structure 07 has one or several formers 09 which are preferably oriented in such a way that webs 11 of material, for example paper webs 11, referred to as webs 11 for short, and running up on the former 09, have a transport direction T1 projected onto the horizontal plane, which transport direction T1 extends along, or parallel with the machinery alignment M1 of the first printing press 01. This means that the webs 11 imprinted in the printing units 02 of the first type can be conducted in a so-called straight-ahead guided manner onto the formers 09. The entire first printing press 01, which is embodied as an in-line press arrangement 01, or a section with at least one printing unit 02 and an associated former structure 07, can also be called a first, in-line press arrangement 30.

The first printing press 01 preferably has several groups of adjoining printing units 02, between each of which one or two former structures 07 is, or are arranged. In this way, the mass product, such as, for example, a newspaper can be produced, overlapping groups selectively, on the first printing press 01, while either individual product sections of the mixed product, or a separate product of, for example greater quality and/or lesser size and/or lesser amount, can be produced on the other printing press 31.

The printing press system can, in principle, be any arbitrary, above-mentioned, combination of two different printing units 02, 03, or printing presses 01, 31, with different circumference and/or different width or effective length or the printing group cylinders 04, 06, 14, 16. However, the printing units 02 of the first printing press 01 are typically configured as printing towers 02, which advantageously have two stacked H-printing units or two stacked satellite printing units, respectively. In principle, the printing towers 02 can also have four double printing groups for two-sided imprinting. In that case, the web 11 runs substantially vertically between the print locations in the printing units 02 of the first printing press 01.

A machinery alignment M2 of the second printing press 31, or in-line press arrangement 25, represented in the drawing figures, extends on the level of the printing group cylinders 14, 16 of the second printing unit 03 in the plane of symmetry which halves the length, and in this embodiment they can also be called center press alignment M2.

Figure 6:
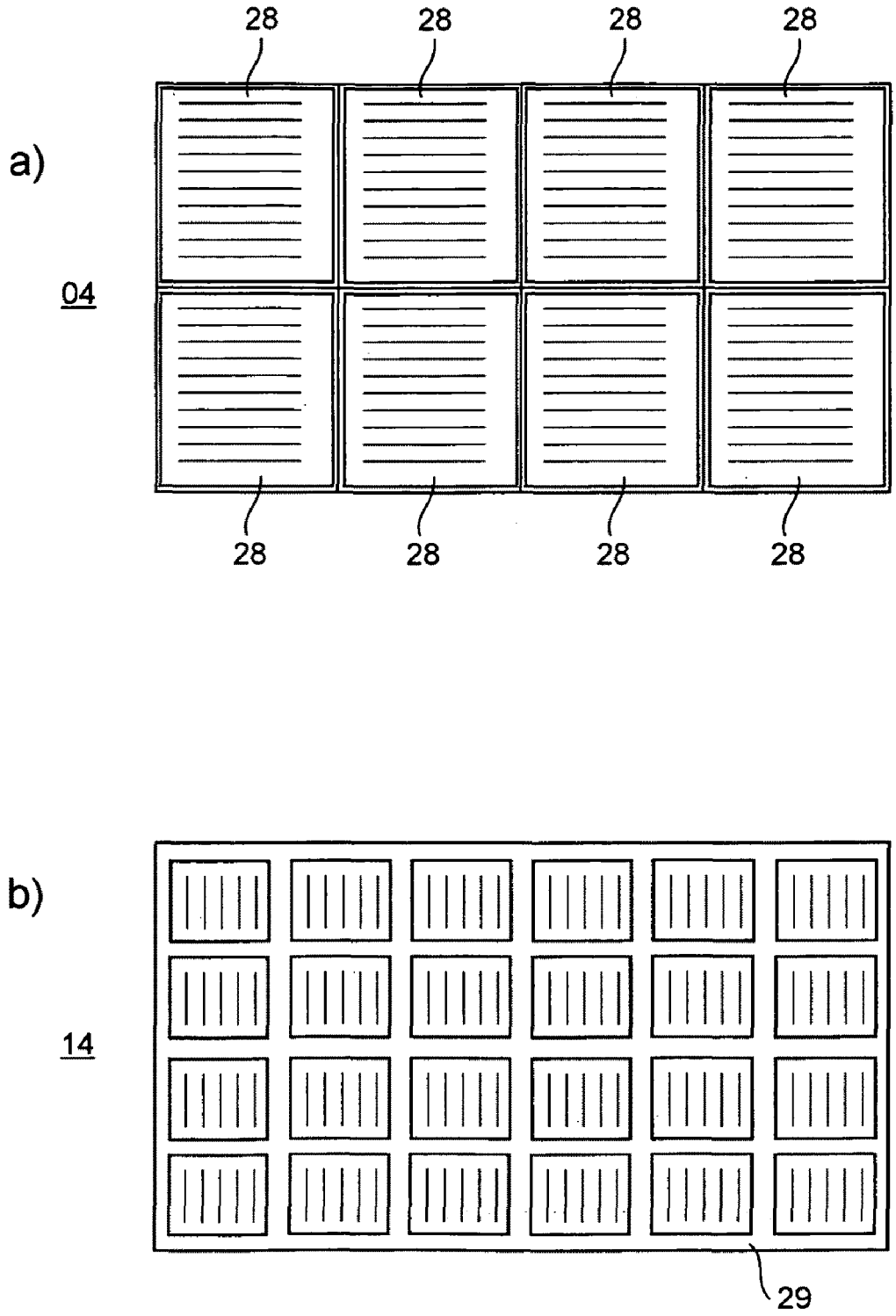

In an advantageous embodiment of the first printing press 01 as "purely" a newspaper printing press 01, it has coldset printing units 02 for newspaper printing as printing units 02 of the first type. With the printing units 02, embodied in particular as coldset printing units 02 for newspaper printing, the printing group cylinders 04, which are embodied as forme cylinders 04, have several printing formes 28, as seen in FIG. 6*a*, on their circumference, viewed, for example, in the longitudinal direction, which, in the axial direction, either support only one print image, such as a single printing forme 28, which is not represented in FIG. 6*a*), or maximally two panoramic printing formes print images of a newspaper page, while viewed in the circumferential direction of the forme cylinder 04 respectively support only one of these print images. Thus, as schematically represented in FIG. 6*a*), the forme cylinder 04 supports for example four printing formes 28 in the axial direction side-by-side, and in the case of double-size forme cylinders 04, supports two printing formes, with one printed page each, in the circumferential direction. In the circumferential direction, single size printing cylinders 04 have only one such printing forme 28. The single printing formes 28 can be replaced individually, or together also in pairs, by panorama printing formes with two printed pages in width. For this purpose, the forme cylinder 04 of the coldset printing unit 02 has on its circumference, for example, one, in the case of a forme cylinder 04 of single size or, one behind the other, two, in the case of a double size forme cylinders 04, grooves each extending in the longitudinal direction over the entire length useful for printing, which grooves are adapted for receiving the printing formes 28. The forme cylinder 04 of the coldset printing units 02 furthermore has, for example, devices, such as, for example, register devices, or axially acting stops, for the lateral alignment of four printing formes 28 situated side-by-side. The embodiment of the forme cylinder 04 mentioned for four printed pages, which has four printed pages, or printing formes 28, side-by-side and four stops, should be applied to a forme cylinder 04 with six printed pages side-by-side corresponding to six printing formes 28 and six stops.

A printing unit 02, which is embodied as a coldset printing unit 02, has an inking group, not specifically represented in any drawing figure, for inking the printing formes 28, which inking group is filled, or is operated, with coldset inks. The coldset ink is distinguished by special auxiliary materials, such as, for example, wetting agents, waxes, yellowing agents, mineral filler materials, which make drying of the imprinted web 11 possible by absorption of the ink by the paper. This takes place, in particular, by the special combination of the coldset ink and the paper used.

The web 11, which is conducted through the coldset printing unit 02, preferably represents uncoated or slightly coated paper having a coating weight of maximally 20 g/m$^2$, and in particular of 10 g/m$^2$ at most.

In the embodiment of the first printing press 01 as a coldset printing press 01 for newspaper printing, the folding group 08 which is assigned to the first printing press 01, and with the former structure 07 arranged in the machinery alignment M1 in a straight-ahead embodiment, is, for example, embodied as a newspaper folding group. The folding group 08, which is embodied as a newspaper folding group, has one or two folding apparatuses, for example embodied as single, or double folding apparatus. The folding group 08 can also have a plurality of individual folding apparatuses. The folding apparatus of the folding group 08, which is embodied as a newspaper folding group has, for example, a cutting cylinder, a transport cylinder, a folding jaw cylinder and possibly a paddle wheel. However, in particular for embodying the folding apparatus for semi-commercial products, it can optionally have an assembly for making a second transverse fold. The folding apparatus of the folding group 08 is advantageously rotatorily driven, mechanically independent of the printing units 02, by at least one drive motor.

In one embodiment, printing group cylinders 14 embodied as forme cylinders 14 of a heatset printing unit 03 for use in semi-commercial printing, can have, in one embodiment, for example, and when viewed on their circumference in the longitudinal direction, only one, but at most two printing formes 29, as seen in FIG. 6*a*), which, when viewed in the axial direction, support at least three, in the case of printing formes in the longitudinal direction or, for example, six, in the case of only one printing forme 29 in the longitudinal direction print images of a tabloid page, such as, for example, a magazine or a telephone book page, and viewed in the circumferential direction of the forme cylinder 04, support several, such as, for example, at least four, of these print images. As schematically represented by way of example in FIG. 6*a*) and viewed, for example, in the axial, as well as in the circumferential direction, the forme cylinder 14 supports, on the rolled-off circumference, only one printing forme 29, which contains, for example, side-by-side, in the axial direction, the print images of six, and in the circumferential direction, the print images of four printed pages in tabloid format, such as, for example, in magazine or in telephone book format. In the case of two printing formes 29, situated side-by-side over the entire circumference of the forme cylinder 14, the printing formes 29 have, for example, respectively three printed pages in tabloid format side-by-side. For this purpose, the forme cylinder 14 of the heatset printing unit 03 has, on its circumference, for example, a groove, extending in the longitudinal direction, over the entire length of the cylinder 14 which is useful for printing for receiving the printing forme or formes 29. Furthermore, the forme cylinder 14 of the heatset printing unit 03 has, for example, an arrangement, such as, for example, one or several register devices, or axially acting stops, for the lateral alignment of one or two side-by-side printing formes 29.

In another embodiment, the second printing unit 03, operated in heatset, can be embodied, in regard to its forme cylinder 04, corresponding to a forme cylinder 04 of a coldset printing unit 03, and can support, on its circumference, a number of printing formes corresponding to the number of printed pages, for example single printing plates. In the case of a double-width printing unit 03, for example, in the axial direction. The cylinder can carry four side-by-side printing formes, and in the case of a triple-width printing unit 03, it can carry, for example, six printing formes with printed pages, for example of a newspaper format.

The forme cylinder 14 of the heatset printing unit 03 can, for example, have an effective, or a usable barrel width for imprinting a web 21 of material, for example paper web 21, or simply web 21 for short, which at least corresponds to the corresponding number of newspaper pages of the format to be imprinted on the newspaper printing press 01.

The heatset printing unit 03 has an inking group, which is not specifically represented in any drawing figure, for use in inking the printing formes 29 which inking group, in at least one mode of operation, such as a heatset mode, is filled, or is operated, with heatset ink. However, if the second printing unit 03 is operated with ink for waterless offset printing, it is possible to employ an ink of the same type, or the same ink, in the second printing unit 03, which is being operated in accordance with the heatset method, and in the first printing units 02, which is being operated in accordance with the coldset method. The heatset ink is distinguished by special oils, for example mineral oils, which evaporate under the effect of heat and in this way permit the imprinted web 21 to dry. These mineral oils typically have a boiling range of 220° C. to 320° C. Related to the ink, they can have a weight proportion of approximately 25 to 40%. Since the ink need not be absorbed in order to dry, it is also possible to imprint paper surfaces with closed pores.

The web 21, which is conducted through the heatset printing unit 03, in the course of a heatset mode, preferably represents satinized and/or more heavily coated paper of a coating weight of more than 10 g/m$^2$, for example at least 15 g/m$^2$. The paper of medium or higher quality can be selected to lie within a range of imprinted paper of greater than 40 g/m$^2$, for example in a range of imprinted paper between 55 and 90 g/m$^2$, and in particular of greater than 50 g/m$^2$. In contrast thereto, the paper which is employed in the coldset mode, can be placed within a weight range of imprinted paper of less than 50 g/m$^2$, and in particular less than 40 g/m$^2$.

The heatset printing unit 03 can preferably be selectively operated in the heatset mode, but also can be operated in the coldset mode, in which it is operated, for example in the first mentioned mode of operation, with heatset ink and/or with heavier coated paper, and, in the second mentioned mode of operation, is operated with coldset ink and/or with uncoated or slightly coated paper. During coldset operation, passage of the web 21 through the dryer 15 can occur, when the dryer 15 is in a deactivated state or it can be bypassed in a changed web course.

The printing unit 03 of the in-line press arrangement 25, in particular of the heatset in-line press arrangement 25 and/or of the second printing press 31, which is embodied as heatset and/or, as a semi-commercial printing press, is configured, for example, as a printing tower 03, which preferably has four stacked double printing groups for two-sided imprinting, so-called bridge or n-printing units. However, in principle, the printing tower 03 can also have two stacked H-printing units, or two stacked satellite printing units.

If the second printing press 31 is configured as a job-lot press, the printing unit 03 has an offset double printing group with four printing group cylinders 14, 16 arranged vertically above each other, as well as having more elaborate inking groups, such as, for example, dual-train roller inking groups with at least three distribution cylinders located in the roller train. Similar to what has been said above in respect to the heatset printing group, for example, the forme cylinders 14 are embodied with a continuous fastening groove and with the possibility of receiving a printing forme 29 extending over the entire width. In this case, too, the job-lot printing units are operated by the use of heatset ink, and the printing press has a dryer 15.

A downstream-located folding group 18, such as, for example, a heatset folding group 18, is assigned to one or to several of these printing units 03 of the second type, such as, for example, heatset printing units 03, or a heatset in-line press arrangement 25. A heatset folding group 18, for use with semi-commercial products, advantageously has further units, such as, for example, an assembly for forming a second longitudinal fold and/or a second transverse fold, and/or a stapler, and/or a plow fold, in addition to the typical cutting cylinder, transport cylinder and folding jaw cylinder.

In a machinery alignment M2, which is extending perpendicularly in relation to the axial direction of the printing group cylinders 14, 16 of the printing group, or groups 03 of the second type, only one printing unit 03 has to be arranged. It is also possible for several printing units 03 of the second type, in the manner of an in-line press arrangement, or at least one printing unit 03 and one dryer 15, and/or other units, such as cooling rollers and/or a varnishing group, to be arranged. Such an arrangement of one, or of several second printing units 03, for example together with an additional dryer 15, etc., in a machinery alignment M2 will also be called in-line press arrangement 25, and in a special case, will also be called heatset in-line press arrangement 25, in what follows. The machinery alignment M2 and/or the throughput direction of a possibly existing dryer 15 extends, for example, substantially perpendicularly, in respect to the machinery alignment M1.

It is also advantageously possible to also assign a turning arrangement, in the superstructure 05, to the first printing press 01, in order to be able to turn the webs 11, or the partial webs 11.1, 11.2, 11.3, which are running in the first printing press 01 in a variable manner, into alignments which are parallel in relation to the machinery alignment M1. In the same way, the second printing press 31 can have in its superstructure 39 its own, turning arrangement, which is not specifically represented, and which permits the turning of the webs 21, or the partial webs 21.1, 21.2, in a variable manner into alignments which are parallel in relation to the machinery alignment M2, as will be disclosed below.

Figure 2:
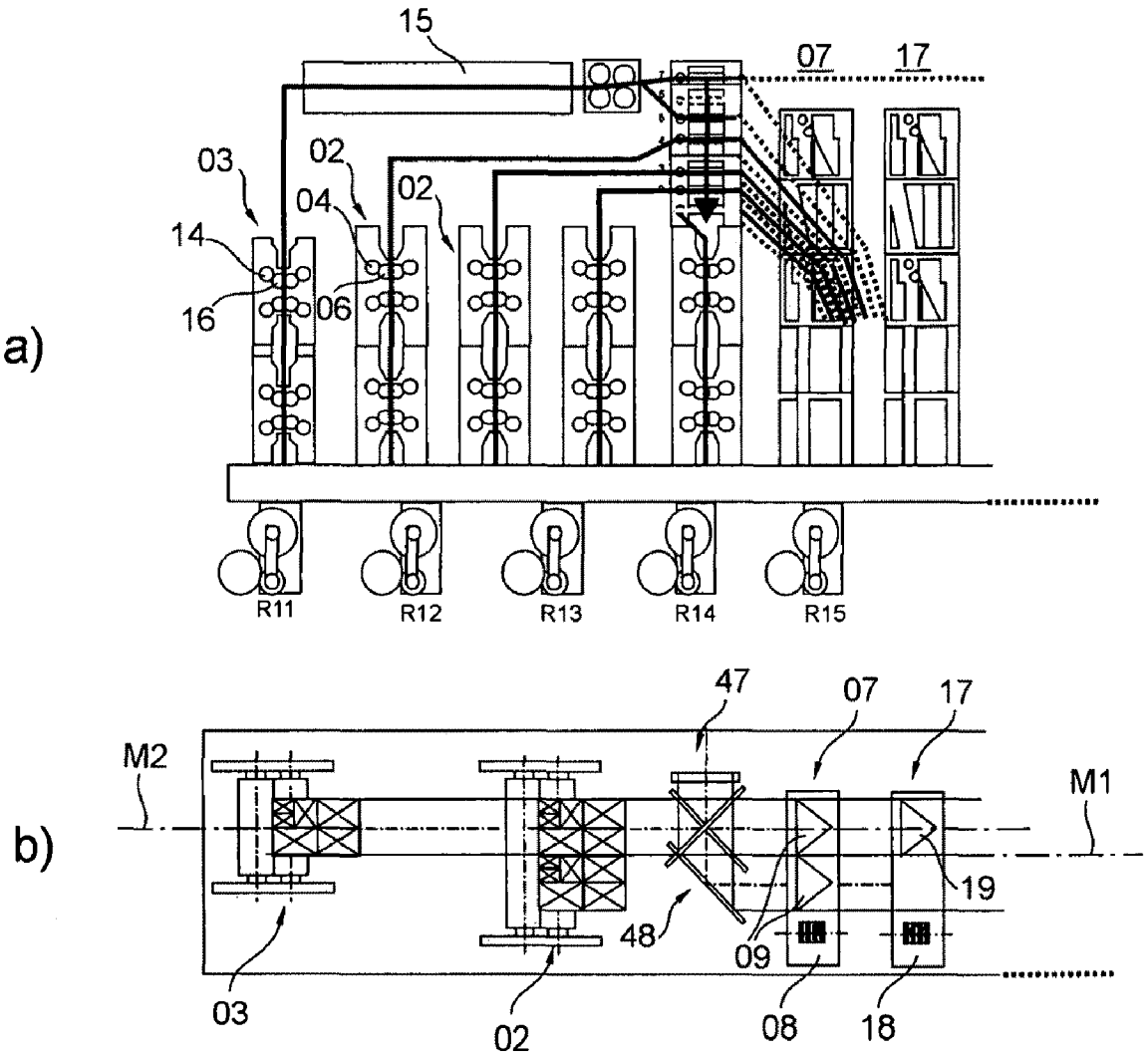

Preferred embodiments of the combination of two printing presses 01, 31, or machinery lines 30, 25, are represented in FIGS. 1 to 5, and in particular in FIGS. 1 and 2, in which, although several printing units 02, 03 of the same type can be arranged in an inline arrangement, the printing units 02, 03 of the same type must not be adjoining each other directly Instead, they can be placed as a function of the requirement in the printing press system.

As shown in FIG. 1, a further, second former structure 17, in addition to the first former structure 07, is assigned to the two printing units 01, 31 in such a way that, in one mode of operation of the printing press system, a separate production run of the one printing press 01 on the one former structure 07, and with the other printing press 31 on the other former structure 17, can be realized, and with the other printing press 31, in the example of FIG. 1 via at least one turning arrangement 10, on the other former structure 17. As described above, in another mode of operation of the printing press system, it is possible to conduct webs 11, 21, or partial webs 11.1, 11.2, 11.3, 21.1, 21.2 from the two printing presses 01, 31 together on one former structure 07, 17.

Depending on the press width or, in other words, the web width maximally to be imprinted, and/or the number of pages, such as, for example, newspaper pages, in the axial direction of the printing cylinders 04, 06, 14, 16) of the two printing presses 01, 31, or their printing units 02, 03, the two former structures 07, 17 can have the same or a different number of formers 09, 19, which are arranged horizontally side-by-side as former groups. Also, depending on the products to be primarily formed on the two printing presses in separate production runs, the former structures 07, 17 can have formers 09, 19 of the same or a differently effective width or former format. Therefore, as in FIG. 1, a former structure 17, 07 can have a group of two, or three formers 09, 19 of a first effective width, in a first former format, and the other former structure 07, 17 a group of one, or of two formers 09, 19, each of the same, or of a different, for example larger, effective width in a second former format. However, one former structure 07, 17 can have a group of two or three formers 09, 19 of a first effective width, a first former format, and the other former structure 17, 07 can have a group of one or two formers 19, 09, respectively, in another, such as, for example, larger effective width and thus providing a second former format. Thus, depending on the requirements, the former structures 07, 17 can differ in number and/or effective width of the formers 09, 19. Here, the width in the run-in section of the former 09, 19 transversely to the incoming web 11, 21 or partial web is understood to be the effective width, or the former format, of the former 09, 19. It corresponds, for example, to the maximum width of a partial web which is to be folded by the use of this former 09, 19, which, in turn, corresponds to the printed page format to be respectively folded. As a rule, a partial web has a width of two printed pages of the corresponding format. For example, the one former structure 17, 07 can also have a group of two formers 19, 09 side-by-side, and the other former structure 07, 17 can have a group of three formers 09, 19 of respectively the same, former format, or differently effective width, which is not specifically represented.

In the case of multi-width presses, such as double-width or triple-width printing units 02, 03, a longitudinal cutting device 34, 36 is provided on the web path between the printing units 02, 03 and the respective associated former structure 07, 17. In case of a printing unit 02, 03 embodied n-times or m-times wide, wherein n, m=1, 2, 3, . . . , in one mode of operation, for example, the forme cylinder 04, 14 supports 2*n, or 2*m printed pages, or single-page-wide printing formes, of a defined format side-by-side in the axial direction, and in particular in a newspaper format. The longitudinal cutting device 34, 36 is embodied for the longitudinal cutting of a web 11, 21 imprinted in this printing unit 02, 03 into at least n or m partial webs 11.1, 11.2, 11.3, or 21.1, 21.2.

Figure 3:
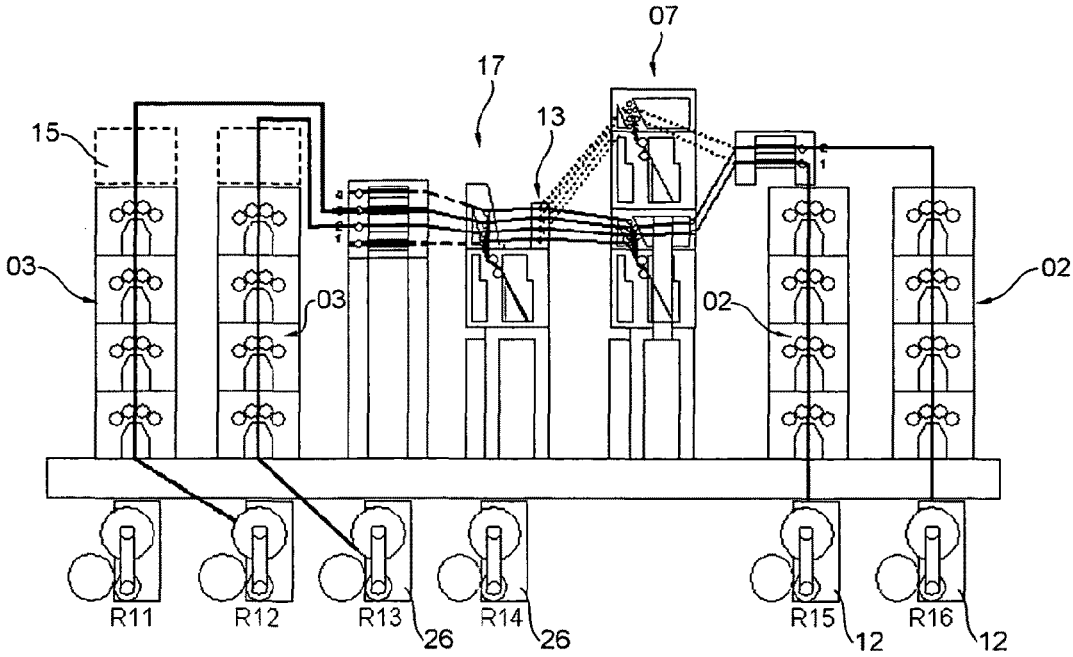
Figure 5:
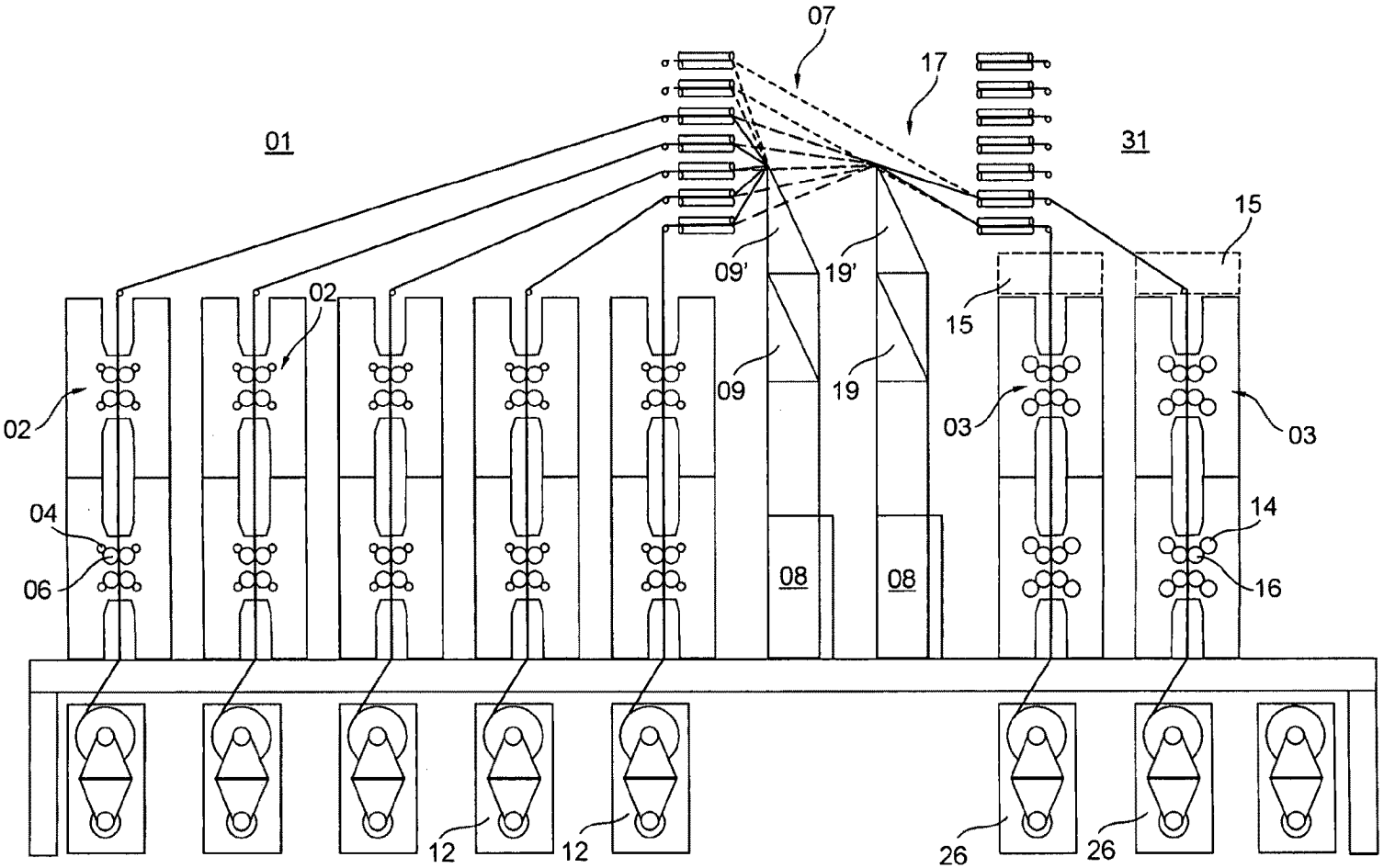

Although printing units 02, 03 of the first and second types are arranged on the same line in the preferred embodiments of FIGS. 1 and 2, they have different machine widths, something which, in connection with an embodiment of the examples in FIGS. 3 and 5, can also be applied to the printing press systems represented there. The placement of the first and second printing units 02, 03 in a line means that, viewed in the longitudinal direction, the printing units 02, 03 overlap in width.

Thus, for example, the printing units 02 of the first type are double-, or even triple-wide and thus are of a width for imprinting four, or even six side-by-side arranged printed pages of one format, and the at least one printing unit 03 of the second type, considered in view of an identical format as that of the printing units 02 of the first type, such as, for example, broadsheet format, is embodied of single width, and thus is of a width for only imprinting two side-by-side arranged printed pages of this format, as seen in FIG. 1*b*) and in FIG. 2*b*). In a variation which is not specifically represented, it is possible for triple-width first printing units 02 to be combined with at least one double-width second printing unit 03. Now the arrangement of the two printing presses 01, 31, or their machinery lines 30, 25, is such that, although the narrower printing units 03, 02, or their printing group cylinders 14, 16, 04, 06, are arranged in the alignment provided by the wider printing unit 02, 03, or their printing group cylinders 04, 06, 14, 16, the center press alignments M1, M2 extend parallel, but laterally offset with respect to each other. The ends of the effective barrel width of the printing group cylinders 04, 06, 14, 16 of the narrower and the wider printing unit, or units 02, 03 are preferably aligned on the one machine side, while the cylinder ends on the other machine side are offset. Preferably the offset between the two center press alignments M1, M2 amounts to a whole number multiple of the width of a print image that is located on the forme cylinder 04 of the first printing unit 02.

A lateral view of the printing press system with several, and here with two groups consisting of first printing units 02, or printing towers 02, and interspersed former structures 07, 17, as well as printing units 03 of the second type located in the same alignment, is represented in FIG. 1*a*). FIG. 1*b*) schematically shows a view from above in which, however, the representation of some first printing units 02 from FIG. 1*a*) has been omitted. Two printing units 03, such as, for example, printing towers 03, of the second type and two dryers 15 are here again assigned to two groups of first printing units 02, and in particular are assigned to two printing towers 02, or two former structures 07 of the first printing press 01. For reasons of space, the dryers are advantageously located, at least partially, above the printing towers 02 of the first type. A former structure 17 of the second type, or a first former structure 17, is provided in the example in accordance with FIG. 1. Preferably, this second former structure 17 differs from the first former structure 07 in the number of formers 09, 19 of a former group and/or in the effective width of one or of several formers 09, 19, as discussed above. In FIG. 1, the second former structure 17 is not arranged in the machinery alignment M2 of the second printing press 31, or of the second printing unit 03, but rotated by 90° and is positioned next to the alignment that is defined by the second printing units 03. The second former structure 17 is oriented in such a way that the incoming direction T3, projected onto the horizontal plane, extends parallel in respect to the linear or axial direction of the printing cylinders 14, 16, or perpendicularly, in regard to the center press alignment M2 of the second printing unit 03. A web 21, which is imprinted in the second printing unit 03, can be conducted, via the turning arrangement 10 and/or via guide rollers 13, selectively onto the first former structure 07 or, if it is deflected by 90°, can be conducted onto the second former structure 17 and to the downstream arranged folding group 18, which may be, for example, a heatset folding group.

In order to guide the web 21, which has been imprinted in the second printing unit 03, onto the second former structure 17, that web 21 is deflected by 90° by a turning arrangement 10. However, for a mixed production run, web 21 is conducted over guide elements 13 onto the, or one of the, first former structures 07. In this case, the turning arrangement 10 can have turning bars 49 which permit the lateral displacement of the web 21 into an alignment which is parallel in respect to the machinery alignment M2, and thus onto one of the other ones of the adjoining formers 09, 09'. Such an arrangement of turning bars 49 can also be considered to be a turning arrangement 48 per se. In this context, see the right side of FIG. 1*b*. Rollers 47 of a so-called bay window arrangement can be additionally provided, by the use of which rollers 47, a web 21, which is rotated by 90°, can be conducted onto another level and can be returned on this other level into the alignment of the press, and can again be brought, via a further turning bar, into a transport direction T1, T2 which transport direction T1, T2 is parallel in relation to the machinery alignment M2 or M1. The bay window arrangement has at least two such rollers 47 which are spaced apart from each other in the vertical direction, and whose axes of rotation extend parallel with respect to the center press alignment M2. Also, two turning bars 49, 43, which are vertically spaced apart from each other, of a turning arrangement, such as, for example, the turning arrangement 10 or 48, should also be counted among the bay window arrangement, for example.

In one embodiment, the turning arrangement 10 can be embodied in such a way that a web 11, or a partial web 11.1, 11.2 from the first printing press 01 cam also be conducted onto the former structure 17.

FIG. 2 shows a variation of the first embodiment of the present invention, as shown in FIG. 1, in which the second former structure 17 now also lies in the machinery alignment M2 of the second printing unit or units 03, instead of being rotated by 90°, as it is in FIG. 1. The second embodiment, which is represented in FIG. 2, has only one group of first printing units 02 and only one first former structure 07, as well as only one second printing unit 03 and a second former structure. However, it is also possible to provide several groups of first printing units 02 and/or several first former structures 07, and/or several second printing units 03, and/or several second former structures 17. In this case, the first former structure 07 can also be arranged, for example, between first printing units 02 in order to make possible the feeding of webs from both sides.

In an advantageous embodiment of the present invention, in accordance with FIG. 2, both printing presses 01, 31, or both machinery lines 30, 25, are respectively configured as printing presses 01, 31 for the straight-ahead running of imprinted webs 11, 21. This means that the former structures 07, 17 are preferably oriented in such a way that webs 11, 21 of material, which are running up onto the formers 09, 19, each have a respective transport direction T1, T2, as projected onto the horizontal plane, which extends along or parallel with the machinery alignment M1, M2 of the respective machinery lines 30, 25. This means that the webs 21, which have been imprinted in the printing groups 02 of the first type, as well as the webs 21, which have been imprinted in the printing groups 03 of the second type, can, in one mode of operation, be conducted straight ahead onto the associated formers 09, 19.

Figure 4:
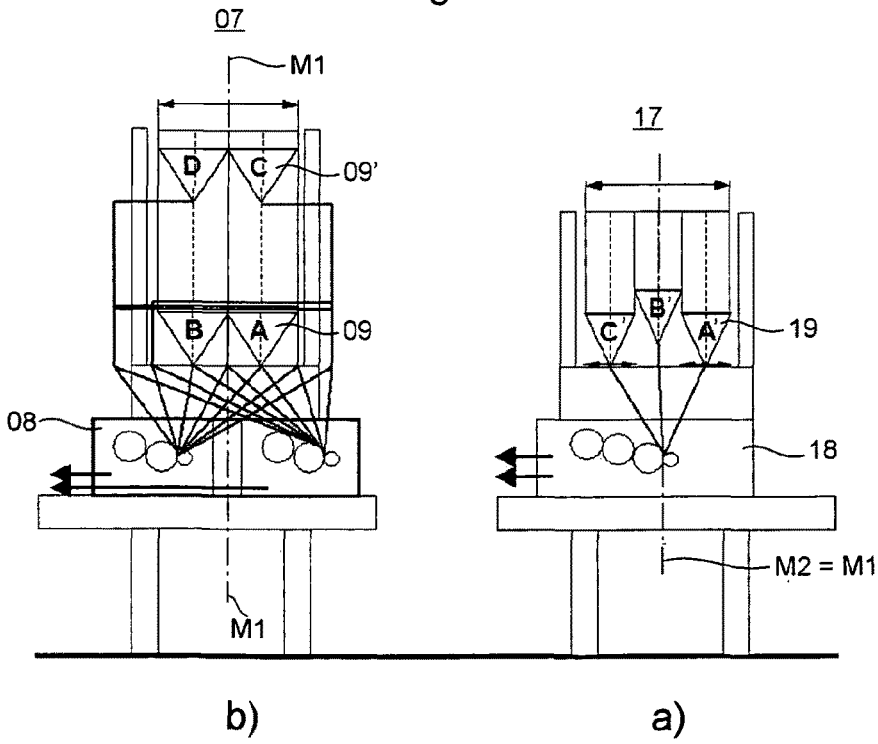

In the two preferred embodiments of FIGS. 3 to 5, the printing press system has, as was shown in FIGS. 1 and 2, a combination of two printing presses 01, 31, or machinery lines 30, 25, wherein several printing units 02, 03 of different types are arranged in the same line, for example. In principle, the printing units 02, 03, or the printing towers 02, 03, can be embodied to have the same width, such as, for example, double-wide or triple-wide in relation to a newspaper format. However, as described in connection with FIGS. 1 and 2, they can also have different widths or different circumferences. In the case of different widths, the center machinery alignments M1, M2 again extend parallel, but are laterally spaced apart from each other.

In FIGS. 3 and 4, the printing units 02, 03, or their printing group cylinders 04, 14, 06, 16 of the first and of the second type have approximately the same maximally effective width which corresponds, for example in a first format, and such as, for example, in a newspaper format, to a width of "i", for example "i"=4, printed pages, such as, for example, newspaper pages. This means that the printing units 02, 03 are embodied to be "n"-times wide in regard to a first format, for example double-wide, wherein "n"=2 and "i"=2*"n"=4, or triple-wide, wherein "n"=3 and "i"*"n"=6. One of the two types of printing units 02, 03 is now embodied for supporting one or several printing formes, such as, for example, "i" printing formes, with a number of "i" print images of the first format in the axial direction of the forme cylinder 04, 14. The other one of the two types of printing units 03, 02 is at least embodied to support one or several printing formes with "j" print images in a smaller, second format, wherein "j">"i". Then, a first former structure 07, 17 has at least one group of "i"/2 formers 09, 09', and a second former structure 17 has at least one group of "j"/2 formers 19. In this case, the second format can for example be a tabloid format, a magazine format or a telephone book format. In the example of FIGS. 3 and 4, the first printing units 02 of the first printing press 01 are double-wide in respect to, for example, a newspaper format, and thus are embodied with four printed pages in the axial direction on the forme cylinder 04. The first former structure 07 then has at least one and here has two, groups of two formers 09, 09' that are arranged side-by-side on one level. With respect to a smaller format, such as, for example, a tabloid, telephone book or magazine format, the printing units are configured as being triple-wide, and thus as having at least one group of three formers 19' on one level. A dryer 15 is preferably arranged in the web path and is arranged downstream of the second printing units 03. The second printing unit or units is or are preferably embodied in such a way that "i" print images here "i"=4 of the larger format, or "j" print images here "j"=4 of the smaller format can be selectively arranged by the use of one or of several printing formes on the forme cylinder 14. Then, in a mixed production, it is possible to combine, on the first former structure 07 for example, partial products of a larger format from the first printing unit 02, and partial products of a smaller format from the second printing unit 03 for example as needed in pop-up production. In another mode of operation of the mixed production, print images of the larger format can also be arranged on the forme cylinder 14 of the second printing unit 03, and the webs 21 with these print images can, for example, be conducted through the dryer 15 and can then be combined with the web 11 of the first printing unit 02 and having print images of a larger format, to form a mixed product.

In FIG. 5, one of the printing presses 01, 31, such as, for example, the first printing press 01, or the first printing unit 02, is configured with forme cylinders 04 of single circumference, and thus with only one print image, or only one printing forme in the circumferential direction of the forme cylinder 04. The other printing press 31, or the other printing unit 03, is configured with forme cylinders 14 of double circumference, and thus with two print images or with two printing formes in the circumferential direction of the forme cylinder 14. One of the printing presses 01, 31 can advantageously be embodied in a 4/1 configuration and the other printing press 01, 31 can be embodied in a 4/2 configuration. In a configuration for larger product thicknesses and/or for more compact structural space, the one printing press 01, 31 can advantageously be embodied in a 6/1 arrangement and the other printing press 31, 01 can be embodied in a 6/2 arrangement. However, the two printing units 02, 03, or the two printing presses 01, 31 can have a different width and an offset in the center machinery alignments M1, M2. They can also differ in the printing process used, as discussed above and/or in the employment of a dryer 15, as is also discussed above. In the represented example, one of the printing presses 01, 31, and in this case the printing press 31, has a dryer 15.

Figure 7:
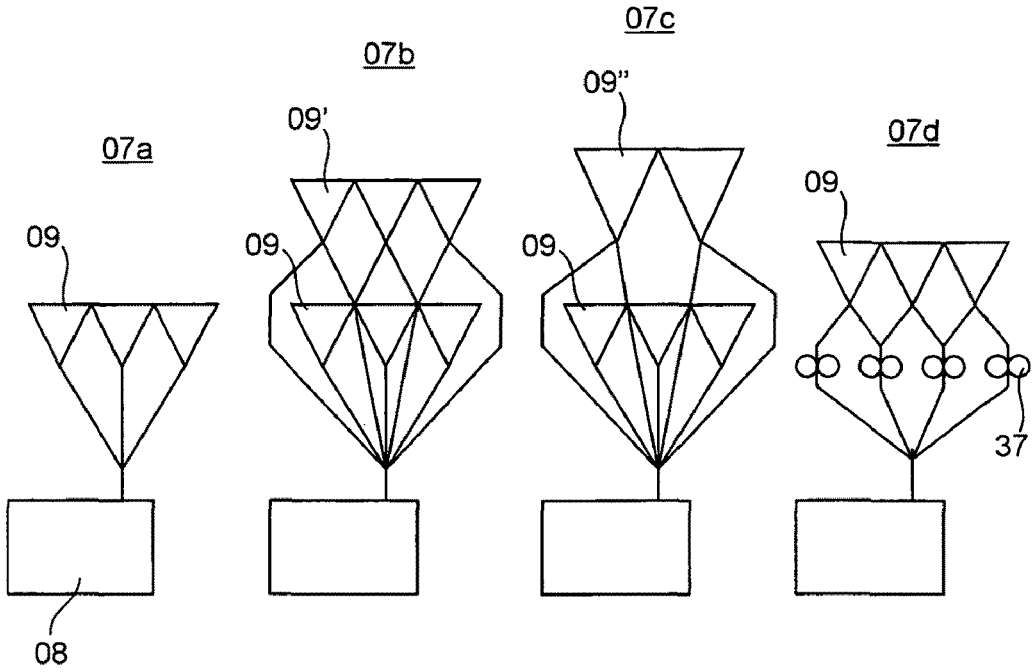
Figure 8:
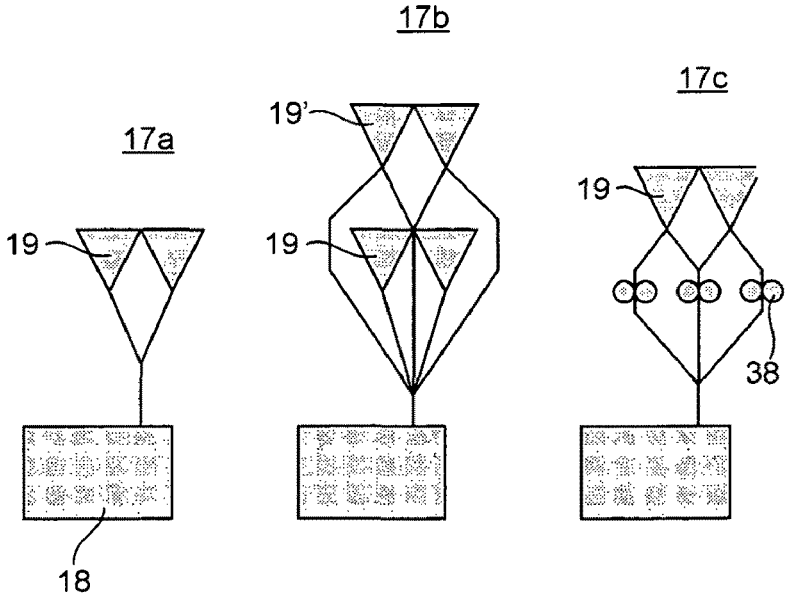

FIGS. 7 and 8 show preferred embodiments of multi-width former structures 07, 17, such as can be used in the above-described preferred embodiments for multi-width, such as, for example, in respect to a defined format double- or triple-width printing presses 01, 31.

Different alternatives for embodiments of a triple-width former structure 07, at least in a defined printed page format, are represented in FIG. 7. The embodiment of the former structure, in accordance with the former structure 07*a*, has a former group of three formers 09 which are arranged only on one level and side-by-side transversely to the incoming direction of a web 11. The effective width of these three formers 09 maximally corresponds to the effective barrel length of a forme cylinder 04 of the printing unit 02 which is arranged in a straight line upstream of the former structure 07, for example. The folding group 08 is arranged downstream of the former group 07*a*. In the embodiment of the former structure 07*d*, the latter has additional, longitudinal cutting arrangements, not specifically shown, and which are located in the web path upstream or downstream of the folders 09 for use in the centered, longitudinal cutting of the partial webs 11.1, 11.2, 11.3 in the area of the back of the fold of the longitudinally folded continuous web. These partial webs, which have been cut open along the back of the fold and which have been placed on top of each other on the same former 09, can now be divided and, depending on the requirements, can be combined via guide and/or traction rollers 37 with a continuous web or with a partial continuous web of an adjoining former 09. This is advantageous in particular if a further processing stage, such as, for example, a gluing device or a stapler, is or are arranged on one or in several of the possible continuous web paths between the formers 09 and the folding group 08. It is possible by this arrangement, and depending on the particular distribution of the continuous webs, to make a variable assignment of the partial webs to stapled/non-stapled or glued/not glued continuous webs.

In the embodiment of the former structure 07*b*, again as shown in FIG. 7, the latter has two former groups 09, 09', each of three formers and each arranged side-by-side on levels which are vertically offset in respect to each other.

In the embodiment of the former structure 07*c*, the former structure has two groups of formers, arranged on top of each other, with a different number of formers 09, 09" arranged horizontally side-by-side as a former group, and/or two groups of formers 09, 19 each of a differently effective width or former format. For example, a first former group is embodied to be of triple-width in accordance with a first printed page format, and thus has three single-width formers 09, in accordance with this printed page format. A second former group, in accordance with a second, such as, for example, a larger printed page format, is embodied to be double-wide and, in accordance with this printed page format, has two single-wide formers 09". The group with the larger numbers of formers 09 has, for example, an effective width, as a whole, which overall effective width corresponds, for example, to the maximally effective barrel length of a forme cylinder 04 of the printing unit 02, which forme cylinder has been placed upstream of the former structure 07 in a straight-ahead manner. In contrast thereto, the wider formers 09" have a significantly greater effective width, such as, for example, being greater by a factor of 1.1, and in particular by a factor of 1.2, than that of the formers 09 of the first group. This former arrangement of the former structure 07*c* is particularly advantageous in connection with printing presses which have been arranged for use in the imprinting of variable web widths and/or in the making of products with different print formats. This arrangement is also advantageous for producing so-called "pop-up" products by the use of the two combined printing presses. A pop-up product is to be distinguished in that, in the folded, or the combined product, one part of the product has a greater width and/or length than another part. The result is that a projection of a partial product over another partial product is formed. In the finished product, this projection is advantageously at least 10 mm, and in particular, is at least 20 mm wide, and advantageously contains a portion of a print image, such as, for example, text.

Various alternatives of the embodiments of a double-width former structure 17, at least in a defined printed page format, are depicted in FIG. 8. The embodiment in accordance with the former structure 17*a* of FIG. 8 has a former group of two formers 19 which are arranged side-by-side, transversely to the incoming direction of a web 21, and at only one level. The effective width of these two formers 19 corresponds, for example, maximally to the effective barrel length of a forme cylinder 14 of the printing unit 03 that is arranged, in a straight line, upstream of the former structure 17*a*. The folding group 18 is arranged downstream of the former group 17*a*. In the embodiment of the former structure 17*c*, as depicted in FIG. 8, the former structure 17*c* additionally has not specifically represented longitudinal cutting arrangements in the web path and which may be located upstream or downstream of the formers 19 for the centered longitudinal cutting of the partial webs 21.1, 21.2 in the area of the back of a fold of the longitudinally folded continuous web. These partial webs, which have been cut open along the back of the fold and placed on top of each other, on the same former 19, can now be divided and, depending on the requirements, can be combined through the use of guide rollers and/or traction rollers 38, with a continuous web or with a partial continuous web of an adjoining former 19. This is advantageous, in particular if a further processing stage, such as a gluing device or a stapler, is/are arranged on one or in several of the possible continuous web paths between the formers 19 and the folding group 18. It is possible by the use of this arrangement, and depending on the distribution of the continuous webs, to make a variable assignment of the partial webs to stapled/non-stapled continuous webs or to glued/not glued continuous webs.

In the embodiment of the former structure identified in FIG. 8 as 17*b*, the former structure has two former groups, each with two formers 19, 19' each such former being side-by-side on levels which are vertically offset in respect to each other.

In an embodiment of the former structure 17, which is not specifically shown, the latter can have, corresponding to the principle depicted in FIG. 7 and specifically therein the former structure 07*c*, two former groups, arranged on top of each other, with a different number of formers arranged horizontally side-by-side as a former group, and/or with two groups of formers of a differently effective width or former format. For example, a first one of the groups may be embodied to be of double-width in accordance with a first printed page format, and has two single-width formers 19 in accordance with this printed page format, while above or below it, a single, significantly wider former, or a group of two wider formers 19, 19' is arranged. In this case, what was said regarding the effective width in connection with the former structure 07*c* also applies here, in a figurative sense. It is possible, by the use of such an embodiment of the former structure 07 in connection with the two printing presses 01, 31, to create a pop-up product.

In connection with all of the previous examples of the printing press system, it may be provided, in a further development, to embody at least one of the printing units 02, 03, and/or at least one of the former structure 07, 17 of the first or second printing press 01, 31, for making so-called "pop-up" products. In this connection, see FIGS. 7, 8, 9 and 10.

Figure 9:
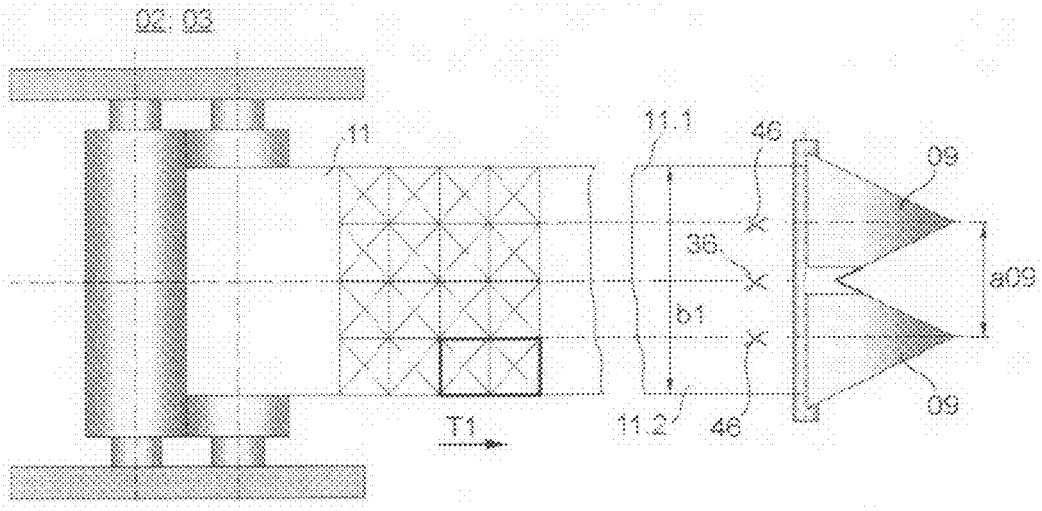
Figure 9:
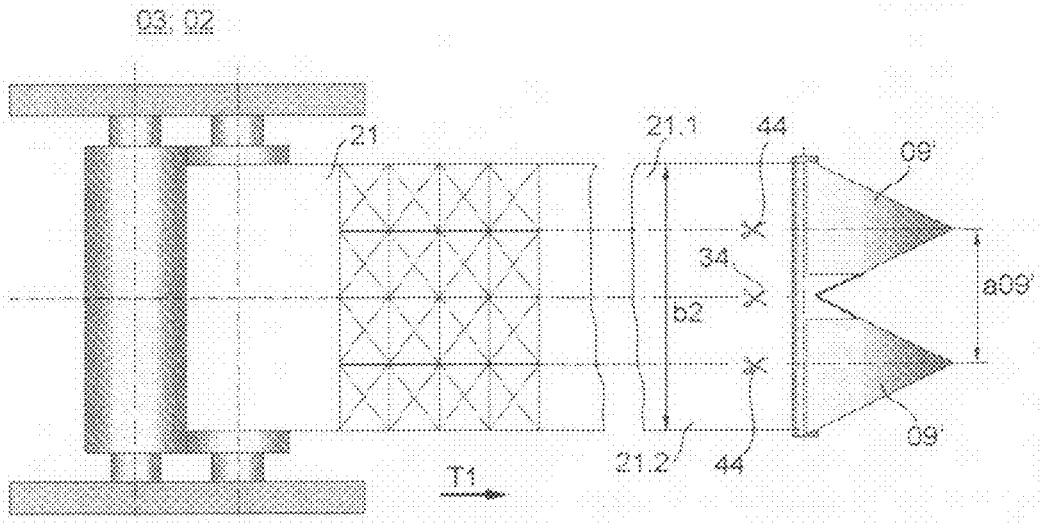
Figure 9:
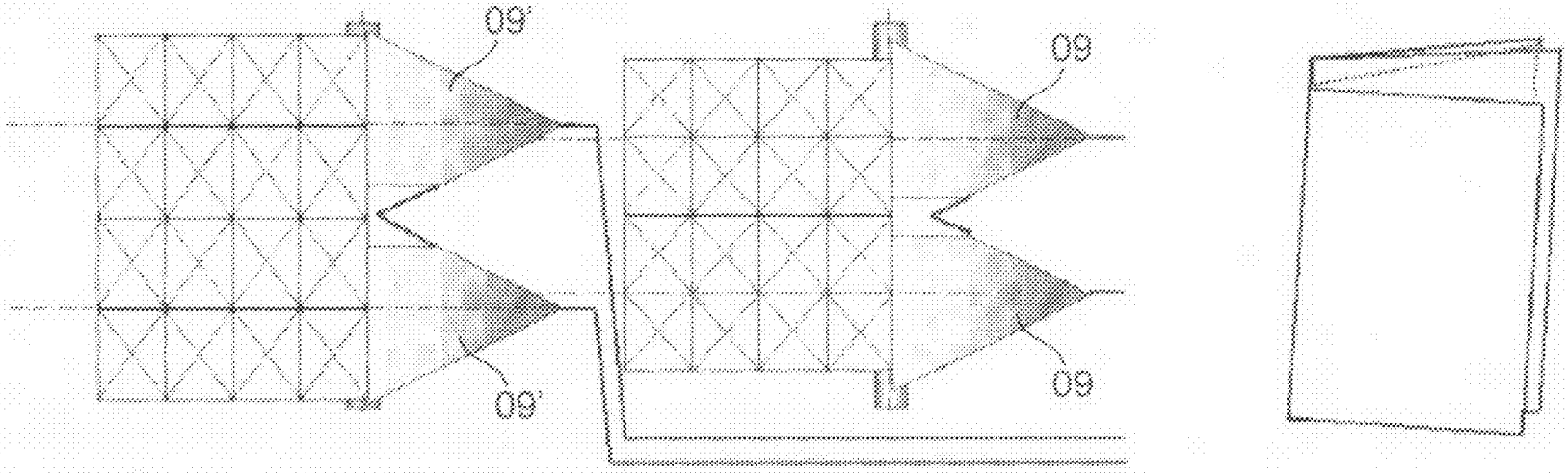

In a first embodiment, a former structure 07 of the first printing press 01 can be embodied with two groups of formers 09, 09' for this purpose, whose effective widths differ and which are therefore structured and usable for folding partial webs 11.1, 11.2, 11.3 of different widths. In a further embodiment the formers 09, 09' of at least one of the two former groups can be configured to be movable in a direction transversely to the web running direction, such as, for example, transversely to the transport direction T1 and, if possible, their effective width should be changeable by the use of insertion pieces which can be removed or which can be tilted out of the way. Depending on the width of the partial webs, the two adjoining formers 09, 09' have then been brought into a position relative to each other in such a way that a distance a09, a09' of the former tips, differently matched to the partial web width, can be different, all as seen in FIG. 9 *a*) to FIG. 9 *c*). FIG. 9 schematically shows the matter by the use of two printing units 02, 03, through which webs 11, 21 of different web widths b1, b2, run. The partial webs 11.1, 11.2, or 21.1, 21.2 of the narrower web 11, or 21 are conducted onto the former group with the smaller distance a09 between the former tips of the formers 09, 09'. The partial webs 21.1, 21.2, or 11.1, 11.2 of the wider web 21, or 11 are conducted onto the former group with the larger distance a09' between the former tips of the formers 09', 09. This principle has been explained, and is depicted in FIG. 9, by the use of webs 11, 21 which are imprinted in the tabloid printing process with horizontal printed pages in tabloid format. In this case, in addition to the longitudinal cutting arrangement 34, 36 for the main cutting lines, additional longitudinal cutting arrangements 44, 46, shown as secondary cutting lines, have been provided between the respective printing unit 02, 03 and the former structure 07, 17, or formers 09, 09', which additional cutting arrangements 44, 46 longitudinally cut the partial webs 11.1, 11.2, 21.1, 21.2 in the area of the fold back which is to be formed or which has already been formed. However, the embodiment that is represented for tabloid formats should also be applied, in the same way, to broadsheet production in which, however, as a rule no cut in the secondary cutting lines takes place, and in which the printed pages are configured as upright printed pages which, as indicated in "bold" in the representation of FIG. 9 *a*), correspond approximately to two tabloid pages.

Figure 10:
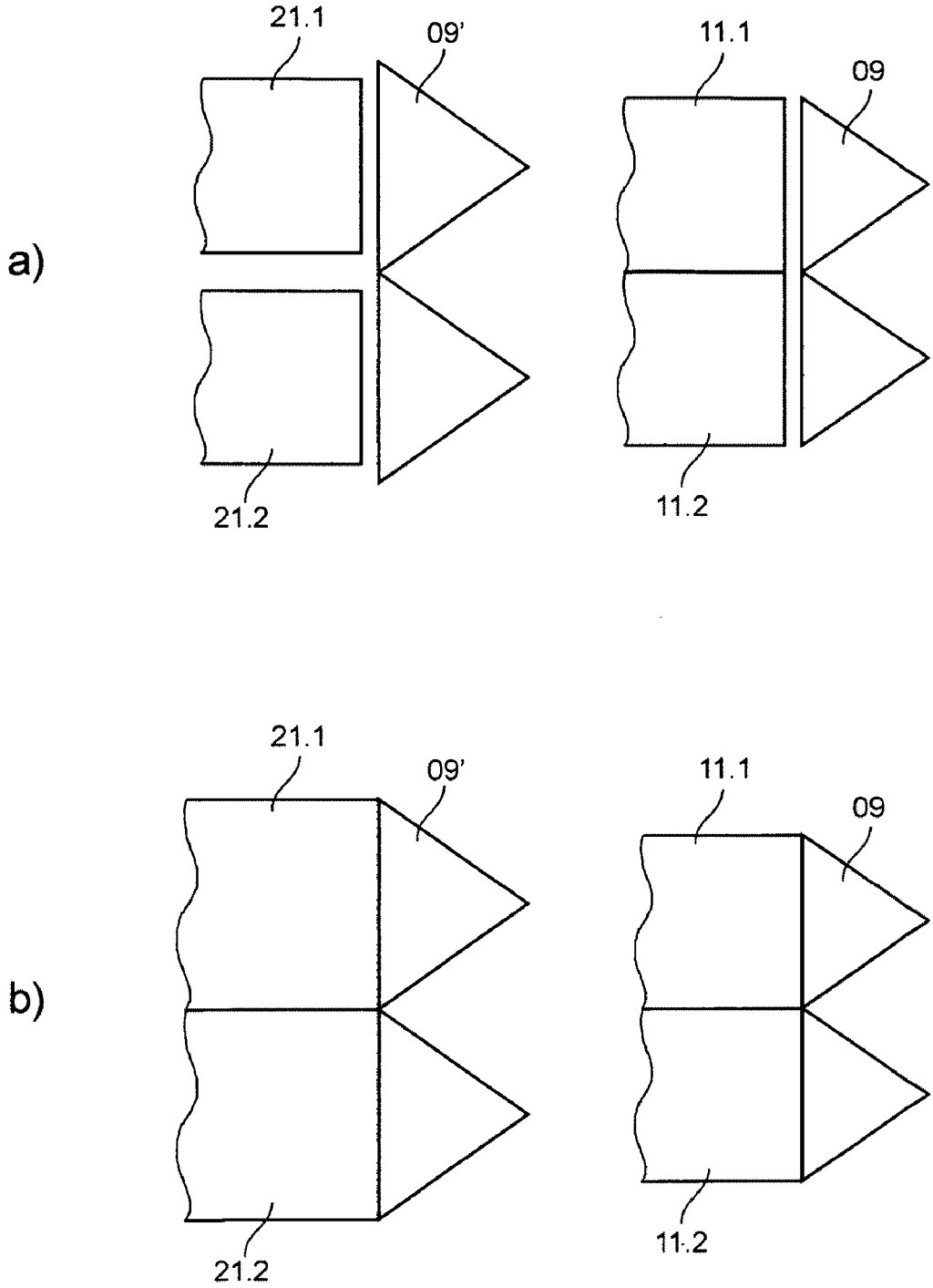

In another variation, the formers 09, 09' of the greater maximally required width, such as, for example, corresponding to the representation in FIG. 10, can be fixedly installed. The web 21, or the partial webs 21.1, 21.2, which had been turned in the previous preferred embodiments, and which provides the wider partial webs 21.1, 21.2 in the mixed mode of operation, along with the formation of pop-ups, is correspondingly turned in. In this case, the printed pages are embodied with a width which is correspondingly greater, as compared with a multiple of the printed page format of the first printing press 01, so that a projection can remain per printed page width. Depending on the partial web width of the web 21, or of the partial webs 21.1, 21.2, which are coming from the side, and which are to be turned into the flow from the first printing press 01, the respective partial web 21.1, 21.2 is aligned with the respective former tip by positioning the turning bars 32, as seen in FIG. 1*b*), which can be advantageously moved transversely with respect to the machinery alignment M1 of the first printing press 01. For a "normal" mixed production, the adjoining partial webs 21.1, 21.2, when viewed from above, extend spaced apart from each other because of the increased effective former width, as depicted in FIG. 10 *a*). In a pop-up production, with maximum projection, or maximum width, the cut and turned-in partial webs 21.1, 21.2 can extend directly next to each other on the adjoining former 09', as seen in FIG. 10 *b*), and depending on the formers 09, 09' to be occupied. Depending on the positioning of the turning bars 32 shown in FIG. 1 *b*), the two partial webs 21.1, 21.2 can also be conducted on top of each other onto the same former 09'.

What has been described and depicted in the individual preferred embodiments, with regard to the configuration of the individual units, such as printing units 02, 03, former structures 07, 17, turning arrangement 10, 42 and/or folding groups 08, 18, and the like, should, whenever logical and possible, also be applied to the respectively other preferred embodiment, and vice versa. The teachings regarding comparable arrangements of the two printing presses 01, 31, or printing units 02, 03, should be applied alternatively to each other in the same way, since, in order to avoid repetitions, not all details have been repeated in each example.

While preferred embodiments of a printing machine system, in accordance with the present invention, have been set forth fully and completely hereinabove, it will be apparent to one of skill in the art that changes in, for example, the drives for the printing units, the specific nature of the webs being printed, and the like could be made without departing from the true spirit and scope of the present invention which is accordingly to be limited only by the appended claims.

What is claimed is:

1. A combined printing press system having a first printing press (01) which is embodied as a newspaper printing press (01), and which has at least two first printing units (02) in a first machinery alignment (M1), each being configured as a printing tower (02), each such printing tower having several first printing groups arranged on top of one another for performing two-sided multi-color printing of a first web, each of said first printing groups having printing group cylinders whose axes of rotation are transverse to said first machinery alignment, said first printing press further having, a first longitudinal former structure (07) arranged in said first machinery alignment (M1) of said at least two first printing units (02) and a first folding unit, said printing press system further having a second printing press, different from said first printing press (31), and which is combined with said first printing press in said combined printing press system and which second printing press has at least one second printing unit (03), with a second machinery alignment (M2), said at least one second printing unit having second printing unit cylinders whose axes of rotation are transverse to said second machinery alignment (M2) and a second longitudinal former structure (17) separate from said first former structure, and a second folding unit, wherein said first printing units (02) and said at least one second printing unit (03) are arranged in a printing press system line parallel to said first and second machinery alignment (M1; M2) wherein, in a projection of each of their widths onto a plane that is perpendicular in relation to the first and second machinery alignments (M1; M2) and to the printing press system line, the first printing units and the at least one second printing unit (02; 03) at least overlap one another, characterized in that the first printing units (02; 03), which are configured as printing towers (02), differ from the at least one second printing unit (03) in at least one of a maximum length of each such printing unit that is effective for printing and a circumference of an image-conveying printing group cylinder of each such printing unit (04; 14) and further wherein, in a mixed production of said combined printing press system, one of a first web and a first partial web printed by said first printing press is combined with one of a second web and a second partial web printed by said second printing unit and said combined ones of said first and second webs and partial webs are conveyed onto said first former structure of said first printing press and in an independent production of said combined printing system, said one of said second web and second partial web printed by said second printing unit is conveyed onto said second former structure of said second printing press separate from said one of said first web and said first partial web from said first printing press.

2. The combined printing press system in accordance with claim 1, characterized in that a bay window arrangement is provided, by means of which said one of a second web (21) or a second partial web (21.1; 21.2) imprinted by the second printing unit (03) can be conducted one of underneath and above said one of a first web(11) and a first partial web (11.1; 11.2) imprinted by the first printing unit (02).

3. The combined printing press system in accordance with claim 1, characterized in that said first and second machinery alignments(M1; M2) extending at the level of a plane of symmetry which divides the printing group cylinders (04;06) in half lengthwise are parallel and laterally spaced from one another.

4. The combined printing press system in accordance with claim 1, characterized in that first ends of the printing group cylinders(04; 06; 14; 16) of the first and second printing units (02; 03), which differ in length, are aligned on one machine side, while the second ends are offset on the other machine side.

5. The combined printing press system in accordance with claim 4, characterized in that the offset between the two machinery alignments (M1; M2) is preferably a whole number multiple of the width of a print image located on an image-conveying printing group cylinder (04) in the first printing unit (02).

6. The combined printing press system in accordance with claim 1, characterized in that said printing group cylinders (04; 06; 14; 16) of said the first and second printing units (02; 03) are arranged substantially parallel in relation to one another.

7. The combined printing, press system in accordance with claim 1, characterized in that with respect to a transport direction (T1; T1'; T2), projected into the horizontal plane, of a web (11; 21) running up on the two former structures (07; 17), the latter are positioned orthogonally to one another.

8. The combined printing press system in accordance with claim 1, characterized in that with respect to transport direction (T1; T1'; T2), projected into the horizontal plane, of web (11; 21) running up on the two former structures (07; 17), the latter are positioned parallel to one another.

9. The combined printing press system in accordance with claim 1, characterized in that the second printing unit (03) and the second former structure (17) are arranged in a shared machinery alignment which itself is extending perpendicularly with respect to the axial direction of the printing group cylinders (14; 16) of the second printing unit (03).

10. The combined printing press system in accordance with claim 1, characterized in that said second printing unit (03) and said second former structure (17) of the second printing press (31) are arranged in the manner of an in-line machine in said machinery alignment (M2), which extends perpendicularly with respect to the axial direction of the printing group cylinders (04; 06).

11. The combined printing press, system in accordance with claim 1, characterized in that a first turning arrangement (10) is provided at least in the machinery alignment (M1) of the first printing press (01), over which first turning arrangement a web (21) imprinted by the second printing unit (03) can be conducted in a production situation onto the former structure (07) of the second printing press (31).

12. The combined printing press system in accordance with claim 1, characterized in that a turning arrangement (10) is provided at least in the machinery alignment (M1) of the first printing press (01), over which turning arrangement a web (11) or partial web (11.1; 11.2) imprinted by the first printing unit (02) can be conducted onto the former structure (17) of the second printing press (17).

13. The combined printing press system in accordance with claim 1, characterized in that the former structure (07) of the first printing press (01) has a group of at least two fold formers (09) arranged side-by-side in the same machine plane.

14. The combined printing press system in accordance with claim 13, characterized in that two such groups of fold formers (05) arranged side-by-side are arranged one on top of the other.

15. The combined printing press system in accordance with claim 14, characterized in that the two groups differ in terms of at least one of the number and the effective width of the fold formers, (09) arranged side-by-side.

16. The combined printing press system in accordance with claim 1, characterized in that the former structure (17) of the second printing press (31) has at least one of one fold former (19) in one machine plane, and a group of at least two fold formers (19) arranged side-by-side in the same machine plane.

17. The combined printing press system in accordance with claim 1, characterized in that the first and second former structures (07; 17) differ in terms of at least one of the number of fold formers (09; 09', 19; 19') arranged side-by-side in one machine plane and/or in terms of the effective width of one or more fold formers (09; 19).

18. The combined printing press system in accordance with claim 1, characterized in that the at least one printing unit (03) of the second printing press (31) is embodied as a printing tower (03) with several printing groups arranged one on top of the other.

19. The combined printing press in accordance with claim 18, characterized in that a web (11) can be imprinted on both sides in a multi-color process in said printing tower of said second printing press (02).

20. The combined printing press in accordance with claim 1, characterized in that the difference in the maximum length is a whole number multiple of the width of a print image located on an image-conveying printing group cylinder (04) in the first printing unit (02).

21. The combined printing press in accordance with claim 1, characterized in that one of the first and second printing units (02; 03) is configured as n-times wide and the other m-times wide, with $n \neq m$, wherein n- or m-times wide means the width for imprinting 2*n or 2*m printed pages in the longitudinal direction of the printing group cylinders (04; 14; 06; 16).

22. The combined printing press in accordance with claim 1, wherein a dryer (15), is arranged in the web path downstream of said at least one printing unit (03) of said second printing press (31).

23. The combined printing press in accordance with claim 1, characterized in that a web (11) imprinted by one of said at least two first printing units is conducted onto one of the former structures (07; 17) without interaction with a means to aid drying; and a web (21) imprinted by said at least one second printing unit is conducted onto one of the former structures (07; 17) after passing through a means to aid drying.

24. The combined printing press in accordance with claim 1, characterized in that a web (11) of uncoated or lightly coated paper having a coating weight of at most 10 g/m$^2$, in particular newsprint, passes through at least one of the at least two first printing units (02) of the first printing press (01), and a web (21) of coated paper having a coating weight of more than 10 g/m$^2$, in particular more than 20 g/m$^2$, passes through the at least one second printing unit (03) of the second printing press (31).

25. The combined printing press in accordance with claim 1, characterized in that the at least first two printing units (02) are embodied as offset printing units and the at least one second printing unit (03) is embodied as a flexographic printing unit.

26. The combined printing press in accordance with claim 1, characterized in that the at least first two printing units (02) are embodied as one of an offset and a flexographic printing unit, and the at least one second printing unit(03) is embodied as a printing unit for a non-impact process.

27. The combined printing press in accordance with claim 1, characterized in that the printing units (02; 03) of different widths maximum lengths are embodied differently in such a way that the maximally effective printing length for these printing group cylinders (04; 06: 14; 16) differs by at least one width of a print image of a printed page arranged on an image-conveying printing group cylinder (04) in the at least two first printing units (02).

28. The combined printing press in accordance with claim 1, characterized in that the printing units (02; 03) of different circumferences are embodied differently in such a way that the circumference of these printing group cylinders (04; 06; 14; 16) differs by at least one length of a print image of a printed page arranged on an image-conveying printing group cylinder (04) in the at least two first printing units (02).

29. The combined printing press in accordance with claim 1, characterized in that the at least two first printing units(02; 03) have printing group cylinders (04; 06) that are the width of at least four printed pages, and the at least one second printing unit (03; 02) has printing group cylinders (14; 16) that are the width of two printed pages of the same format.

30. The combined printing press in accordance with claim 1, characterized in that at least one image-conveying printing group cylinder (04) of each of the at least two first printing units (02; 03) has a circumference which corresponds to the length of two printed pages, and at least the image-conveying printing group cylinder (04) of the at least one second printing unit (03; 02) has a circumference which corresponds to the length of only one printed page of the same format.

31. The combined printing press in accordance with claim 1, characterized in that a web (11) imprinted by the at least two first printing units (02) can be conducted, onto the first former structure (07) arranged in the first machinery alignment (M1), while at the same time, a web (21) imprinted by the second printing unit (03) can be conducted, onto the second former structure (07).

32. The combined printing press in accordance with claim 1, characterized in that a first partial web (11.1; 11.2; 21.1; 21.2) coming from the first printing press (01; 31) and containing print images of printed pages of a first format, and a second partial web (21.1; 21.2; 11.1; 11.2) coming from the second printing press (31; 01) and containing print images of printed pages of a second format, which is different from the first format, are conducted onto the same former structure (07; 17).

33. The combined printing press in accordance with claim 32, characterized in that the first and second partial webs (11.1; 11.2; 21.1; 21.2) have different widths.

34. The combined printing press in accordance with claim 1, characterized in that an image-conveying printing group cylinder (04; 14) of each of the at least two first printing units (02) supports four printed pages of a defined format side-by-side in the axial direction, and an image-conveying printing group cylinder (14; 04) of the at least one second printing unit (02) supports two printed pages of a defined format side-by-side in the axial direction.

35. The combined printing press in accordance with claim 1, characterized in that an image-conveying printing group cylinder (04; 14) of each of the at least two first printing units (02) supports six printed pages of a defined format side-by-side in the axial direction, and an image-conveying printing group cylinder (14; 04) of the at least one second printing unit (02) supports two printed pages of a defined format side-by-side in the axial direction.

36. The combined printing press in accordance with claim 1, characterized in that an image-conveying printing group cylinder (04; 14) of each of the at least two first printing units (02) supports six printed pages of a defined format side-by-side in the axial direction, and an image-conveying printing group cylinder (14; 04) of the at least one second printing unit(02) supports four printed pages of a defined format side-by-side in the axial direction.

37. The combined printing press in accordance with claim 1, characterized in that an image-conveying printing group cylinder (04; 14) of each of the at least two first printing unit (02) supports four printing formes with printed pages of a defined format, side-by-side in the axial direction, and an image-conveying printing group cylinder (14; 04) of the at least one second printing unit (02) supports two printing formes with printed pages of a defined format side-by-side in the axial direction.

38. The combined printing press in accordance with claim 1, characterized in that an image-conveying printing group cylinder (04; 14) of each of the at least two first printing units (02) supports six printing formes with printed pages of a defined format side-by-side in the axial direction, and an image-conveying printing group cylinder (14; 04) of the at least one second printing unit (02) supports two printing formes with printed pages of a defined format side-by-side in the axial direction.

39. The combined printing press in accordance with claim 1, characterized in that an image-conveying printing group cylinder (04; 14) of each of the at least two first printing units (02) supports six printing formes with printed pages of a defined format, particularly a newspaper format, side-by-side in the axial direction, and an image-conveying printing group cylinder (14; 04) of the at least one second printing unit (02) supports four printing formes with printed pages of a defined format, side-by-side in the axial direction.

40. The combined printing press in accordance with claim 1, characterized in that an image-conveying printing group cylinder (04; 14) of one of the first and second different printing units (02; 03) supports two printing formes with printed pages of a defined format in the circumferential direction, and an image-conveying printing group cylinder (14; 04) of the other of the first and second printing unit (03; 02) supports only one printing forme with one printed page of a defined format in the circumferential direction.

41. The combined printing press in accordance with claim 11, characterized in that in addition to the first turning arrangement (10), the first printing press (01) has a superstructure including a longitudinal cutting device and a second turning arrangement for partial-width webs.

* * * * *